United States Patent [19]

Green

[11] Patent Number: 4,493,251

[45] Date of Patent: Jan. 15, 1985

[54] TRASH AND GARBAGE COMPACTOR

[76] Inventor: Richard Green, 19131 Delaware St. Apt. 18A, Huntington Beach, Calif. 92648

[21] Appl. No.: 427,913

[22] Filed: Sep. 29, 1982

[51] Int. Cl.[3] ..... B30B 1/26

[52] U.S. Cl. ..... 100/53; 100/229 A; 100/268; 100/292

[58] Field of Search ..... 100/229 A, 245, 258 R, 100/268, 292, 53

[56] References Cited

U.S. PATENT DOCUMENTS

| | | | |
|---|---|---|---|
| 203,345 | 5/1878 | Keim | 100/292 X |
| 313,914 | 3/1885 | Bock | 100/292 X |
| 2,122,316 | 6/1938 | Ganio | 100/292 X |
| 3,557,600 | 1/1971 | Saito et al. | 100/292 |
| 3,648,600 | 3/1972 | Jaccard | 100/268 X |
| 4,036,152 | 7/1977 | Bright | 100/229 A X |
| 4,216,713 | 8/1980 | Jung | 100/292 X |

*Primary Examiner*—Billy J. Wilhite
*Assistant Examiner*—Christine A. Peterson
*Attorney, Agent, or Firm*—Francis X. LoJacono

[57] ABSTRACT

A trash-and-garbage-compactor apparatus having a power-driven cam lobe, whereby the circular motion of the cam lobe is transferred into an alternating rectilinear motion for the overriding spring-loaded ram rod. The ram rod includes a first tubular ram-rod member and a second ram-rod member having an overriding spring interposed therebetween, the first ram-rod member operably engaging the cam lobe and the second ram-rod member having a pressure plate attached thereto. The pressure plate is formed to be received in a trash receptacle defined by a drawer slidably mounted to the compactor housing.

1 Claim, 6 Drawing Figures

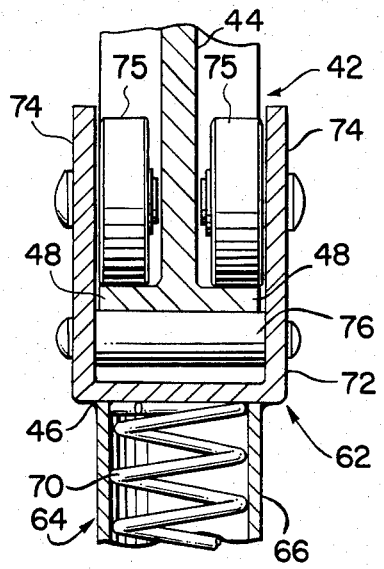
FIG. 3
FIG. 4
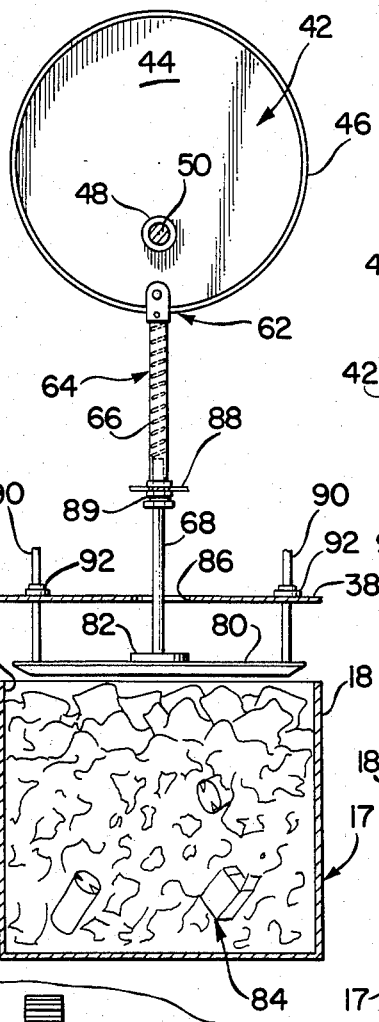
FIG. 5
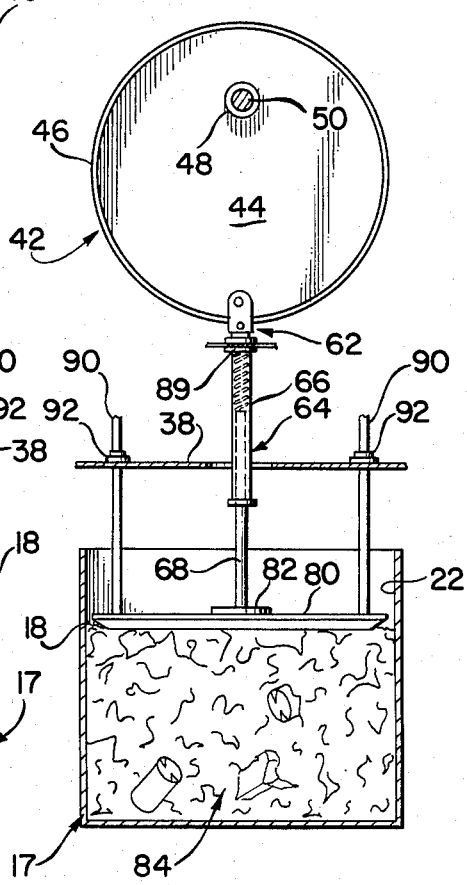
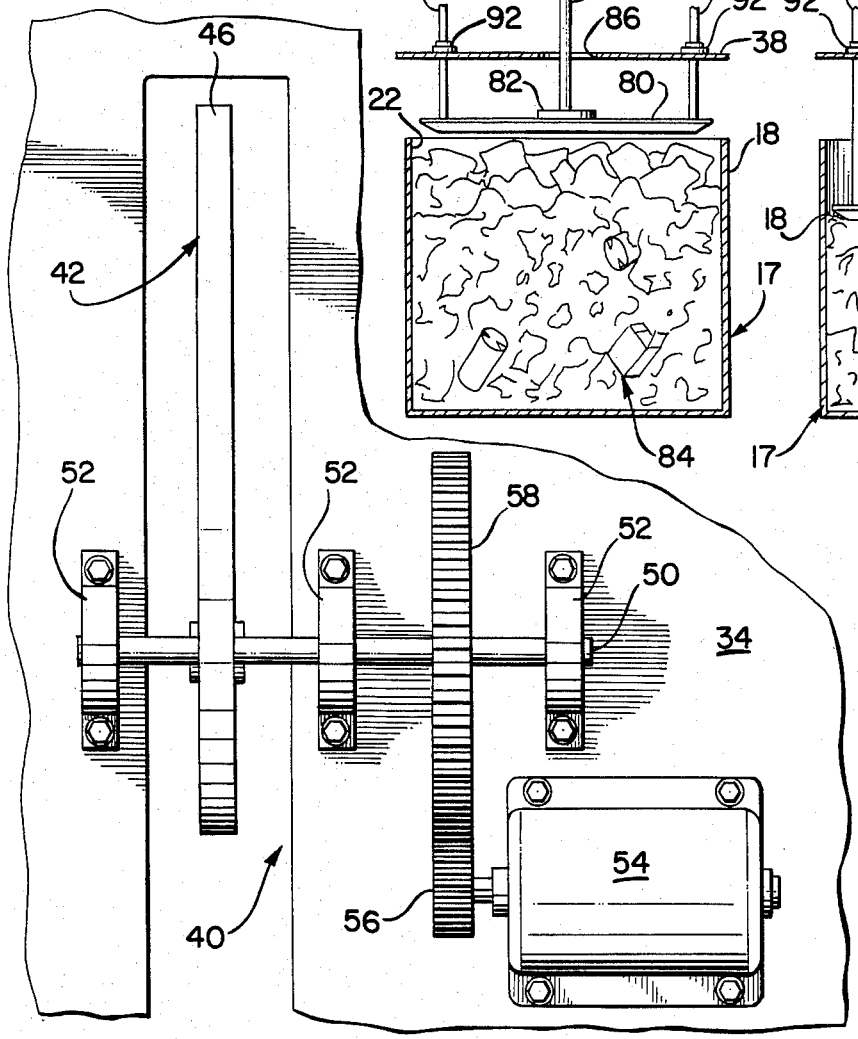
FIG. 6

TRASH AND GARBAGE COMPACTOR

BACKGROUND OF THE INVENTION

1. Field of the Invention

The present invention relates generally to a refuse compactor apparatus, and more particularly to a trash-and-garbage compactor having a simplified cam-override-operating mechanism which provides a very lightweight unit for both domestic as well as commercial use.

2. Description of the Prior Art

It is well known in the art that various problems and difficulties are being encountered in providing a lightweight refuse compactor that is compatible for domestic as well as commercial applications.

The many known types of refuse compactors are divided generally into two groups—commercial and domestic. The commercial units are usually complicated and bulky, and are expensive to operate and maintain. The domestic or household units—although smaller in size—are very often too large and heavy for moving and cleaning.

As examples of several known compactors, the following United States patents are mentioned.

U.S. Pat. No. 3,654,855 discloses a refuse compactor unit for household use having a receptacle for collection of trash and a hydraulic cam operated by connecting it to the household water supply.

In U.S. Pat. No. 3,688,686 there is disclosed a refuse-compactor apparatus having a housing with an internal chamber adapted to accommodate refuse, a plunger being mounted in the chamber for reciprocating movement. An operating means is provided for automatically cycling the displacement of the plunger from and to its retracted position. The compactor housing includes a side-mounted hopper and an open end having a hinged cover against which trash is pressed by a hydraulic cylinder mechanism.

A kitchen-type compactor is disclosed in U.S. Pat. No. 3,691,944. This unit also employs a hydraulic cylinder and piston assembly that is attached to the household water supply flowing into the hydraulic cylinder.

U.S. Pat No. 4,036,152 discloses a combination refuse compactor having an incinerator means included therein.

Other compactor units of interest can be found in U.S. Pat. Nos. 3,727,546; 3,741,108; 4,036,152 and Re. 27,774.

SUMMARY AND OBJECTS OF THE INVENTION

The present invention has for an important object to provide a refuse compactor that is compatible for use in a residential units as well as in commercial establishments, the device being capable of operating efficiently under various demanding conditions.

It is another important object of the present invention to provide a suitable compactor for trash and garbage having a simplified lightweight operating mechanism that includes a motor-operated gear train for rotating a cam-lobe plate, the cam portion thereof being established by mounting a circular plate eccentric to the drive shaft of the gear train. The plate includes a flanged rim or ring interconnected to a spring-loaded ram rod, so as to translate the rotational movement of the cam lobe into an alternating rectilinear motion of the pressure plate. The pressure plate is attached to the slidable override ram rod which effects the downward movement of the pressure plate after a given force is established in the compacting position.

Still another object of the present invention is to provide a compaction unit of this type that is compatible for use in areas other than commercial and residential. For example, the unit as herein disclosed is applicable for use in recreational vehicles and boats, and can be adapted to operate on both A.C. and D.C. electrical systems.

A further object of the invention is to provide a compactor of this character that has relatively few operating parts.

A still further object of the invention is to provide a device of this character that is easy to service and maintain.

It is still another object of the invention to provide a device of this character that is relatively inexpensive to manufacture.

Still another object of the invention is to provide a refuse compactor of this type that is simple but rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 3 is a cross-sectional view taken substantially along line 3—3 of FIG. 2;

FIG. 4 is a schematic view of the present operating mechanism showing the pressure plate removed from the trash receptacle;

FIG. 5 is a similar view to that of FIG. 4 showing the pressure plate in a fully depressed mode; and FIG. 6 is a top-plan view of the compactor mechanism.

DESCRIPTION OF THE PREFERRED EMBODIMENT

Figure 1:
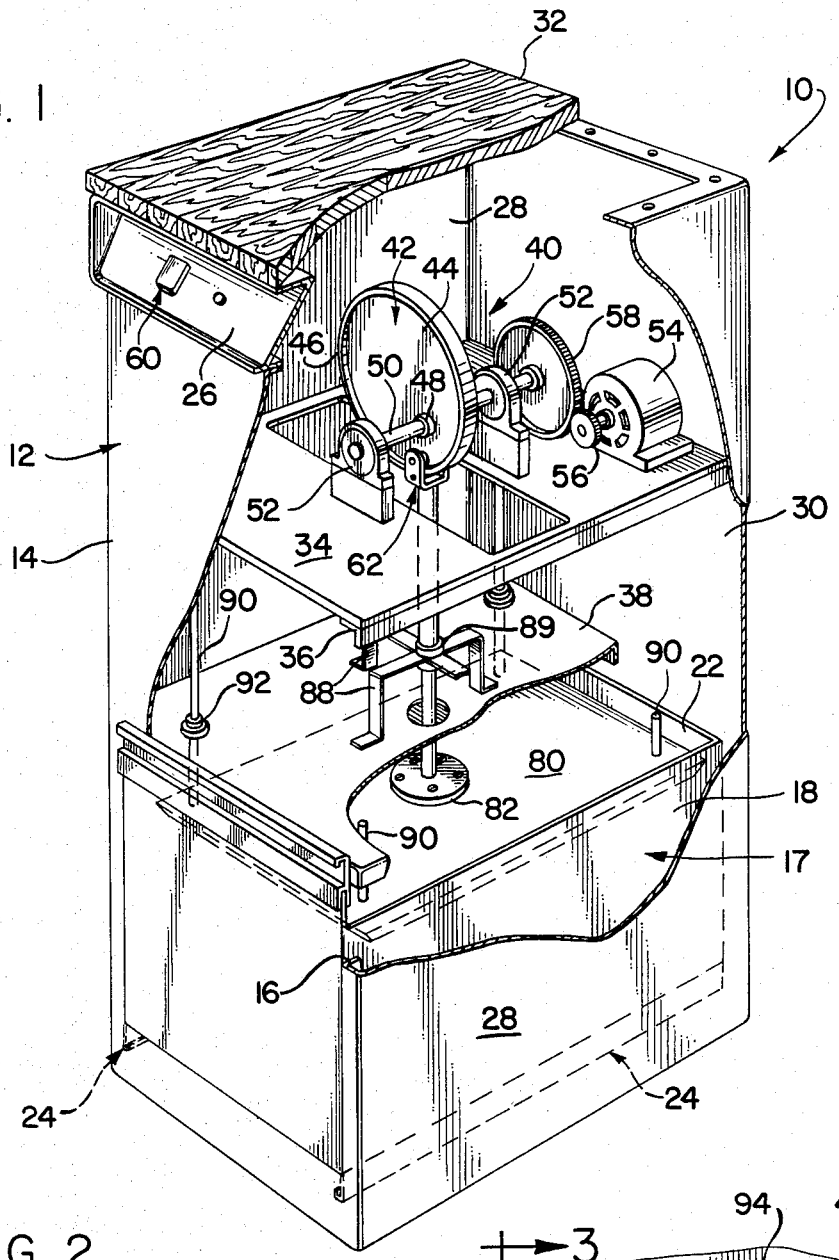
FIG. 1 is a perspective view of the compactor having a portion of the housing broken away to show the working mechanism thereof, with the pressure plate being in a substantially upper position within the trash receptacle.
Figure 2:
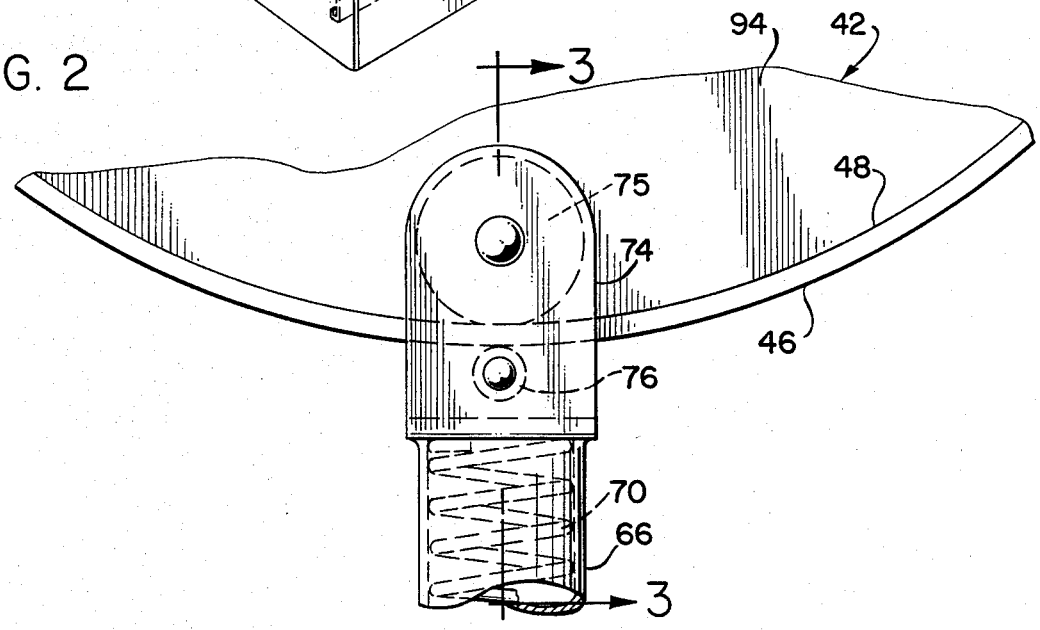
FIG. 2 is an enlarged side-elevational view of a portion of the cam lobe and the cam follower formed on the upper end of the ram rod.

Referring more particularly to FIG. 1, there is illustrated a trash-and-garbage compactor (generally indicated at 10) having a housing 12, the front wall 14 thereof being provided with an opening 16 through which is received a slidable drawer 16 defining a receptacle 18. The receptacle 18 can be in any suitable configuration, but preferably being of a rectangular box-like shape with the front wall 20 forming part of the front wall 14 of the housing when in a closed mode.

Drawer 17 is also adapted to be readily slidable in and out of housing 12 for access to the receptacle compartment 22. Thus, sliding means, designated at 24, is mounted between receptacle 18 and housing 12. The sliding means may be any suitable type that can withstand heavy loads, yet can simply and easily allow the receptacle to slide in and out as well as to be removable from the housing when required for cleaning and repairs.

Accordingly, housing 12 is defined by front panel 14 having a control panel 26, opposite side panels 28, and a rear panel 30, the upper end of housing 12 being closed off by top panel 32 which can comprise any suitable material, but is herein shown as a wood cutting board.

However, it should be further understood that the present compactor is so designed that it can be suitably constructed having a very small overall size so as to be readily applicable for installation and use in various recreational vehicles, including boats. This has been heretofore impractical if not impossible.

The interior framework of the housing can also vary, but is shown having a structural supporting shelf 34 which includes angle members 36 and an intermediate partition 38. Partition 38 can also be mounted to the members or it can be tack-welded for additional support of the housing walls.

The compactor-operating mechanism, indicated generally at 40, comprises a cam-lobe member 42 which is formed by a circular disc 44 having an annular cam ring 46 defined by oppositely disposed lateral flanges, as seen in FIG. 3. Disc 44 of the lobe includes a mounting hole 48 which is located off center from the disc in an eccentric manner, thereby establishing a cam action when rotated about the axis of hole 48. Cam lobe 42 is rotatably supported on shelf 34 by drive shaft 50 which is mounted in oppositely disposed bearing members 52. Shaft 50 is driven by a motor 54, the shaft being interconnected to the motor by a gear train comprising a first gear 56 mounted to motor 54 and a second enlarged gear 58 mounted to shaft 50. Thus, as motor 54 is activated by a switch means, such as indicated at 60, lobe 42 is rotated in an eccentric manner as illustrated in FIGS. 4 and 5.

Operably connected to cam lobe 42 is a cam-follower means, designated at 62, which comprises a ram rod 64 having a first tubular rod member 66 and a second rod member 68 adapted to be slidably positioned within tubular rod member 66. The second rod member 68 is under continuous load by means of override spring 70 located in tubular rod 66, one end of which is engaged by rod 68.

The upper connecting end of rod 66 comprises a yoked member 72 having side arms 74 to which are mounted opposing rollers 75 and a single transverse cam-follower-bearing member 76. The rollers are arranged to engage each respective ring-flange member 48 on the inner side thereof, bearing 76 being arranged to engage the outer annular ring surface. Thus, as the lobe is rotated, ring 46 engages bearing 76, forcing cam rod 64 downwardly as seen in FIG. 5. As the lobe further rotates to a position as seen in FIG. 4, rollers 75 engage with flanges 48, thus causing the cam rod to be pulled upwardly.

Fixedly connected to the end of rod member 68 is a pressure plate 80 having the same general shape or configuration as the compartment 20 of receptacle 18. In this embodiment, receptacle 18 and its compartment 22 are rectangular in shape, and are adapted to receive most of the well known disposable compactor bags therein (not shown). Pressure plate 80 is secured to rod 68 by base member 82, whereby plate 80 will move vertically up and down in a rectilinear motion produced by the combination action of the cam lobe 42 and cam follower means 62.

Accordingly, when refuse 84 is deposited in receptacle 18 as seen in FIG. 4, pressure plate 80 is located above the receptacle. This allows the receptacle to be rolled out to receive refuse 84 and then to be relocated under plate 80. Switch 60 is pushed to activate the drive system, causing plate 80 to press against refuse 84 and compressing it into a compacted mode, as illustrated in FIG. 5. The cam rods are centrally positioned to pass through opening 86 formed in partition 38, thus applying a central force which is evenly distributed over the plate.

There is also provided a stabilizing means to prevent plate 80 from jambing as it encounters any uneven resistance. Various arrangements of stabilizing means can be used. However, the present device comprises a plurality of mounting struts 88 affixed to partition 38, as seen in FIG. 1. The struts include a central bushing 89 adapted to slidably receive rod member 66, whereby cam rod 62 is held in a vertical position at all times. Furthermore, there is included a plurality of stabilizer arms 90, each of which is preferably located adjacent a corner of the pressure plate 80, the arms extending upwardly through partition 38 and being vertically aligned by bushing means 92.

It should be also noted that spring 70 provides an override load means. That is, when the maximum force or load is reached by the compactor as it presses against the refuse in receptacle 22, tubular rod 66 will be allowed to reach its maximum downward stroke by compressing the spring 70 which is interposed between rod 66 and rod 68, as seen in FIG. 5. Hence, spring 70 will be provided with a given load factor which must be exceeded when the compacting load has reached its preset limit. Therefore, damage is prevented to any of the operating components of the compactor system.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in present claims.

I claim:

1. A trash-and-garbage-compactor apparatus comprising:

a housing having an upper portion and a lower portion defined by an intermediate partition and an opening formed in said lower portion of the front wall thereof;

a drawer slidably mounted within said lower portion of said housing so as to be selectively positioned between an open and a closed mode, said drawer defining a refuse receptacle;

means attached to said drawer to allow said drawer to be slidably positioned in either an open or a closed mode;

a frame structure provided within said housing;

cam means supported by said frame structure and positioned in said upper portion of said housing;

a pressure plate attached to said cam means and adapted to be received in said receptacle to compress said refuse disposed therein when said receptacle is in a closed mode; and drive means mounted in said upper portion of said housing and operably connected to said cam means, wherein rotational movement of said cam means is transferred into an alternating rectilinear movement of said pressure plate;

wherein said cam means comprises:

a cam lobe driven by said drive means, and formed having a cylindrical disc including an annular peripheral ring, said disc being eccentrically attached to said drive means; and a cam-follower means having one end engaging said annular peripheral ring of said cam lobe, and the opposite end thereof attached to said pressure plate, said cam-follower means comprising a ram rod having an overriding means;

wherein said engaging end of said ram rod comprises:

a yoke member;

a pair of oppositely disposed rollers attached to said yoke member to engage the inner surface of said annular ring on opposite sides of said disc member; and a roller bearing mounted in said yoke member for engagement with the outer peripheral surface of said ring, whereby said ring is interposed between said rollers and said roller bearing; and wherein said overriding means comprises said ram-rod which is formed having a first ram-rod member and a second ram-rod member, said first ram-rod member being formed as a tubular member adapted to slidably receive said second ram-rod member therein, and interposing a pre-loaded biasing spring between said first and second ram-rod members, said spring being positioned within said first tubular ram rod member for engagement with said second ram rod member, whereby said second ram rod member can slide within said first ram rod member after said pressure plate is prevented from reaching its downward maximum length of travel;

said pressure plate including a stabilizing means which comprises a plurality of stabilizer rods mounted to said pressure plate adjacent each corner thereof and slidably supported within said intermediate partition;

wherein said drive means comprises:

a motor;

a gear train operably connected to said motor;

a drive shaft rotated by said gear train, said cam lobe being eccentrically mounted to said drive shaft; and means mounted to said intermediate partition for vertical alignment of said ram rod.

* * * * *